US005459372A

United States Patent [19]

Roh

[11] Patent Number: 5,459,372

[45] Date of Patent: Oct. 17, 1995

[54] IMPREGNATED CATHODE STRUCTURE

[75] Inventor: Hwanchul Roh, Kyunggi, Rep. of Korea

[73] Assignee: Samsung Electron Devices Co., Ltd., Kyunggi, Rep. of Korea

[21] Appl. No.: 348,249

[22] Filed: Nov. 28, 1994

Related U.S. Application Data

[63] Continuation of Ser. No. 896,662, Jun. 10, 1992, abandoned.

[30] Foreign Application Priority Data

Jun. 13, 1991 [KR] Rep. of Korea ..... 91-9767

[51] Int. Cl.[6] ..... H01J 19/04

[52] U.S. Cl. ..... 313/270; 313/346 R; 313/441; 313/346 DC

[58] Field of Search ..... 313/270, 346 R, 313/346 DC, 441

[56] References Cited

U.S. PATENT DOCUMENTS

| | | | |
|---|---|---|---|
| 3,176,180 | 3/1965 | Affleck, III | 313/346 R |
| 3,263,115 | 7/1966 | Glascock, Jr. et al. | 313/346 DC |
| 3,436,584 | 4/1969 | Hughes et al. | 313/346 R |
| 4,379,979 | 4/1983 | Thomas et al. . | |
| 4,417,173 | 11/1983 | Tuck et al. . | |
| 4,528,474 | 7/1985 | Kim | 313/346 R |

FOREIGN PATENT DOCUMENTS

| | | | |
|---|---|---|---|
| 0052835 | 5/1981 | Japan | 313/346 R |
| 0068527 | 4/1985 | Japan | 313/346 R |
| 0225328 | 11/1985 | Japan | 313/346 R |

OTHER PUBLICATIONS

Dispenser Cathodes: The Current State of the Technology; L. R. Fulce, IEDM 83; pp. 448–451, Dec. 1983.

*Primary Examiner*—Donald J. Yusko
*Assistant Examiner*—N. D. Patel
*Attorney, Agent, or Firm*—Watson, Cole, Grindle & Watson

[57] ABSTRACT

An impregnated cathode structure has:(1) a sleeve having a truncated conically-shaped top portion with an opening having a predetermined diameter at the center thereof;(2) oxide cathode material formed within and conforming to the shape of the sleeve to form a point exposed through the opening;(3) a receiver forming part of said sleeve for retaining the oxide cathode material;(4) a backing plug which divides the inside of the sleeve so as to form a space for the receiver;and (5) a heater installed in the sleeve below the backing plug.

3 Claims, 2 Drawing Sheets

IMPREGNATED CATHODE STRUCTURE

This application is a File Wrapper Continuation Application of application Ser. No. 07/896,662, filed Jun. 10, 1992, now abandoned.

FIELD OF THE INVENTION

The present invention relates to a cathode structure used in electron guns of cathode ray tubes and, in particular to an impregnated cathode structure of impregnated in such an application for noticeably reducing the diameter of the electron beams produced thereby.

BACKGROUND OF THE INVENTION

A known impregnated cathode is formed such that a porous tungsten base which is formed from tungsten powder, is impregnated with electron emitting material. The cathode is received in a storing bath made of high melting point metal and the electron emitting face of the cathode is coated with platinoid elements. It is known that such cathode has the advantages of longer life and better quality than those of a conventional oxide cathode material made of carbonate.

To obtain such a desirable cathode structure, the porous tungsten base is made by being pressed or sintered and impregnated with an electron emitting material having barium as a main element to soak into the porous space formed in the electron emitting material. A part of one side which forms the electron emitting face in the tungsten base is removed, and an impregnated portion remains, and then after the tungsten base is received in a molybdenum receiver, the exposed face is coated from the bath with platinoid elements.

The cathode structure formed as described above emits electrons such that when the porous tungsten is heated at 1000°– 1200° C. by an associated heater, barium oxide (BaO), a barium type electron emitting material impregnated in the tungsten, is separated and barium Ba is reduced to free barium, which spreads over the surface of the cathode.

U.S. Pat. No. 4,379,979 issued to Thomas et. al. Apr. 12, 1983 and U.S. Pat. No. 4,417,173 issued to Tuck et. al. Nov. 22, 1983, disclose improved examples related to the above-described impregnated cathode structure.

In the interim period, color cathode ray tubes, especially cathode ray tubes having high resolution, improve the screen visibility by minimizing the diameter of the beam spot formed on screen.

Generally, to reduce the diameter of beam spot, a material having high current density is used in the impregnated cathode. Further, the aperture diameter of a control electrode(first grid) is minimized from 0.6 mm Ø to 0.3 mm Ø. However, as aperture diameter of the control electrode becomes small, the charge which is applied to the cathode should be increased. At that time, electron emission from the cathode is rapidly increased beyond that necessary, so the useful life of the cathode is noticeably shortened.

SUMMARY OF THE INVENTION

One object of the present invention is to provide an impregnated cathode structure which can restrain the amount of electron emitting to a predetermined level when a high charge applied to the cathode structure.

To obtain this object, the present invention comprises; a sleeve with a top portion having a truncated conical shape with an opening having a predetermined diameter and formed at the centerline of the sleeve; conically-shape oxide type cathode material is received in this sleeve and forms a narrow neck portion which is exposed through the opening;and a backing plug which divides the inside of sleeve so as to form separate spaces in which a receiver space contains the oxide cathode material and the other space contains a heater.

BRIEF DESCRIPTION OF THE DRAWINGS

The objects, features and advantages of the subject invention are believed to be apparent from the following description of a preferred embodiment of the best mode of carrying out the invention when taken in conjunction with the following drawings, wherein.

DETAILED DESCRIPTION OF THE INVENTION

Figure 1:
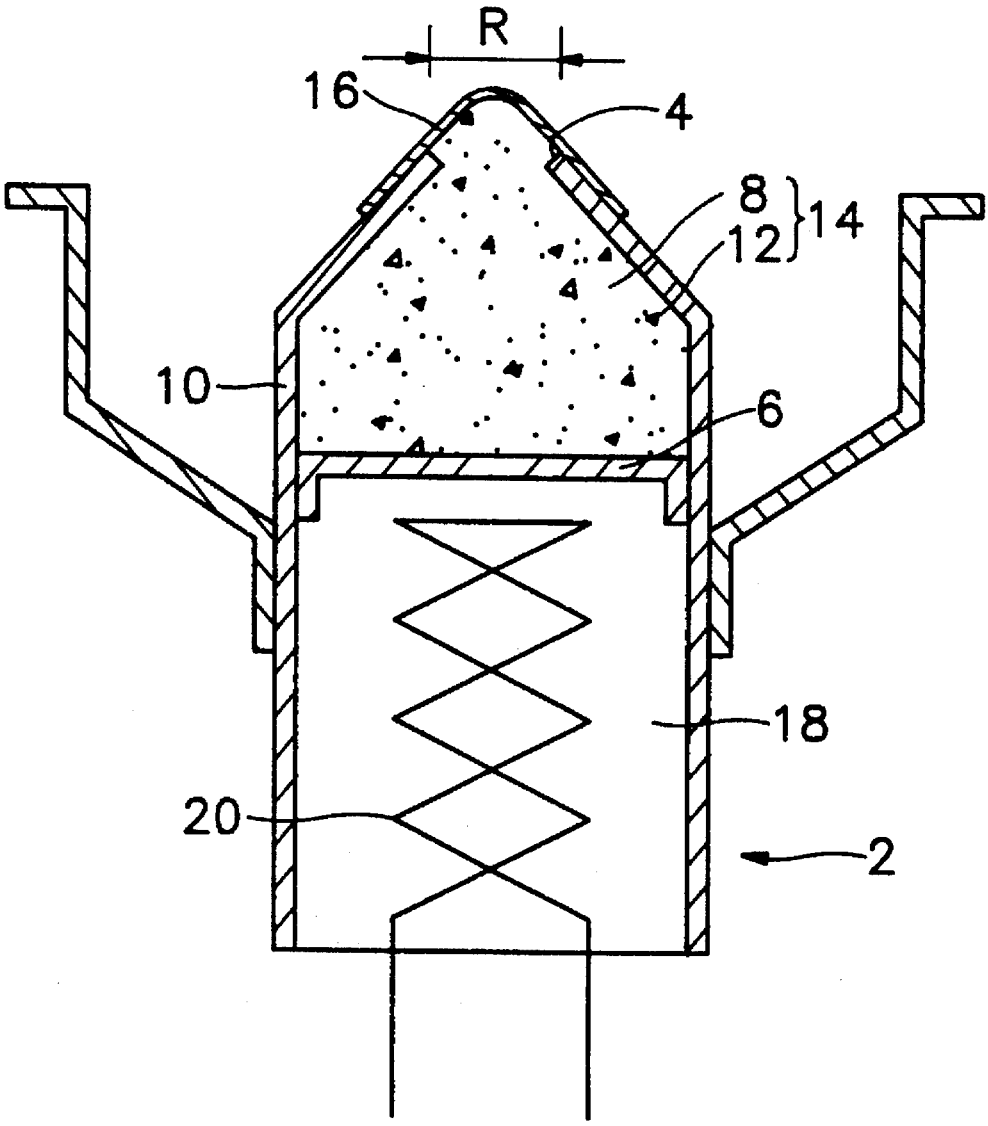
FIG. 1 is a sectional view of a sleeve of an impregnated cathode structure.

The cathode structure in accordance with the present invention has a conically-shaped top portion 11 as shown in FIG. 1. A sleeve 2 is made of metal having high melting point, such as molybdenum, is formed in a truncated conical shape and includes opening 4 having a predetermined diameter R at the center of the top portion 11. The inside of sleeve 2 is divided by a backing plug 6 which is installed later in the manufacturing process after the impregnated cathode has been formed. The upper side of both divided portion of sleeve 2 is a receiver 10 for retaining porous tungsten 8, which is deposited inside of sleeve 2 before installing the backing plug 6 and is compressed after depositing so that the conically-shaped point thereof is exposed through the opening 4. The porous tungsten 8, which is solidified in a conic shape, is impregnated with an electron emitting material 12 to form an oxide cathode material 14. Before installing the baking plug 6, the electron-emitting material 12 is deposited in the sleeve 2. At the surface of the exposed oxide cathode material 14 there is deposited a coating layer 16 formed by platinoid elements, such as Os, Ru,Ir and the like. Lastly, the backing plug 6 divides the sleeve 2 into the upper and lower sides. At the lower space 18, a conventional heater 20 is installed so as to complete the cathode structure.

The electron emission of the cathode structure formed according to the present invention is aided by heater 20 and is restrained at a certain level without excessive emission though the oxide cathode material 14 even with such material in highly charged state because of the limited sectional area having a diameter limited by the opening. Because of that physical restraint limiting excessive electron emission, the emitting duration of the electron emitting material 12 impregnated in the porous tungsten 8 becomes much longer than that of conventional cathode structure thereby producing a cathode having a longer life even when in a highly charged state.

Also, the sectional area of the cathode structure of the present invention becomes gradually smaller in close proximity to the point 11 due to the oxide cathode material 14 formed in a conic shape and therefore, all the periphery except a part of the point 11 is shielded by the sleeve 2, which is the truncated conical shape whereby free Ba, which is separated and reduced from the porous tungsten 8, is concentrated near the exposed point 11 through the opening 4. Accordingly, the region of the point of the oxide cathode material 12 is the region where the density of free Ba becomes the highest in spite of having the smallest volume of material. Because of the highest density of free Ba near the point 11, although the Ba electrons have a minimum emitting diameter, maximum current density is maintained to obtain a minimum beam spot needed in a cathode ray tube having high precision.

FIGS. 2A–2D represent respective sectional views of a preferred manufacturing process for forming the impregnated cathode structure of the present invention.

1. Process for pressing

Figure 2A:
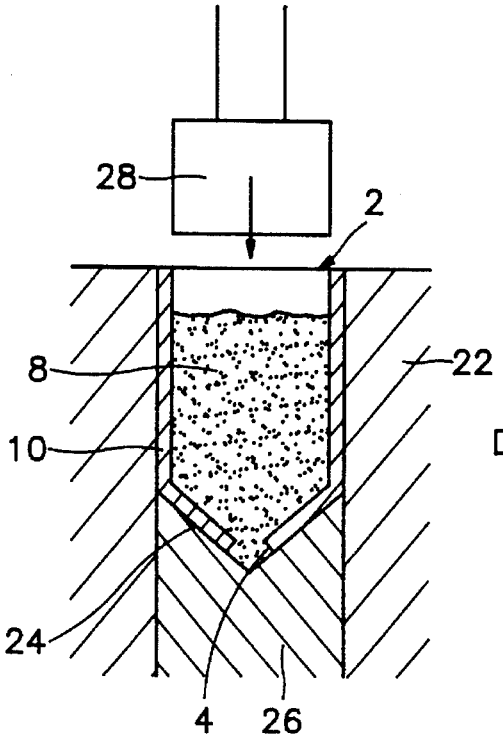
FIGS. 2A–2D are respective sectional views illustrating the manufacturing process for forming impregnated cathode structure in accordance with the present invention.
Figure 2B:
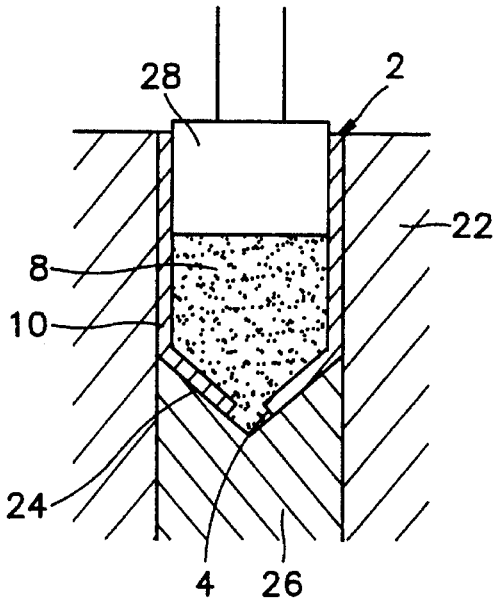

The sleeve 2 is put into an appropriate die 22 as shown in FIG. 2A. The top portion of opening 4, shaped as a truncated conical member, is formed by an injector pin 26 where a concave groove 24 of conical shape is formed. Powder type porous tungsten 8 is put into the inside of sleeve 2. A punch 28 compresses the powdered tungsten 8 at 500– 600 $Kg/cm^2$ to sinter the porous tungsten as shown in FIG. 2B.

After the compressing process, the porous tungsten 8 is solidified into a conical shape while exposing the tungsten point 11 through the opening of sleeve 2.

2. Process for forming the cathode

The electron emitting material 12 formed from barium or calcium aluminate is coated on the solidified porous tungsten 8 and then heated in the vacuum or reduced atmosphere at 1500°–1800° C. Thus the electron emitting material 12 is impregnated in the porous tungsten 8 by fusion to form the oxide cathode material. The process of impregnating the porous tungsten oxide can be carried out at a vacuum atmosphere or in a reduce atmosphere of hydrogen.

Figure 2C:
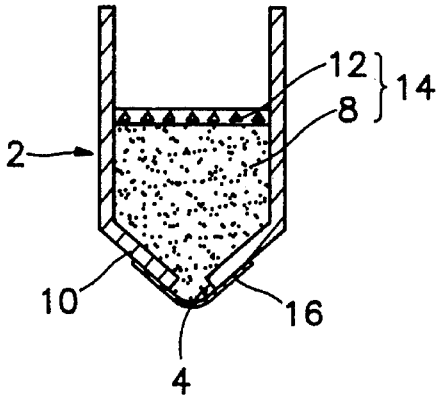

Following the impregnating process, the coating layer 16 is deposited on the surface of the cathode which is exposed through the opening 4 as shown in FIG. 2C.

3. Process for dividing the receiver space

Figure 2D:
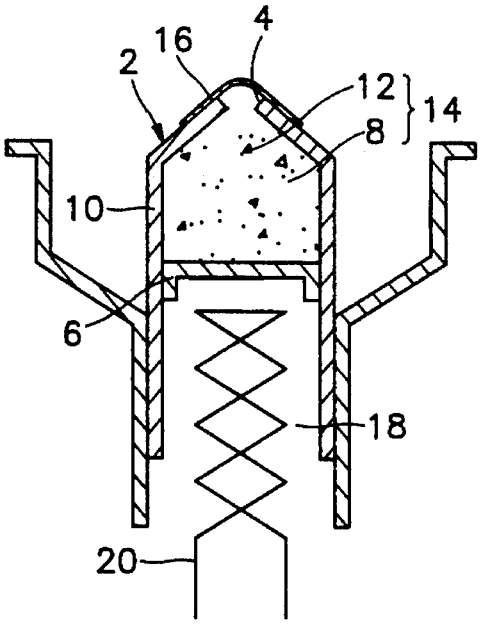

The backing plug 6 is placed at the inside of sleeve 2 in contacted with the base of oxide cathode material 14 at that time when it is welded to the sleeve 2 as shown in FIG. 2D. Thus, the receiver which can receive and preserve the oxide cathode material 14 is formed at the upper portion 10 of the cathode structure 2. At the lower portion 18 of the cathode structure 2, a heater 20 is inserted to complete the cathode structure.

Accordingly, the impregnated cathode structure which can limit the amount of electron emission at a predetermined level is obtained. Those skilled in the art of cathode structures will recognize that the above-described cathode structure can be modified without departing from the invention. The above description of the invention is not intended to limit the scope of coverage afforded the invention, which is to be determined by the following claims and the equivalents to be accorded to the recitations therein.

What is claimed is:

1. An impregnated cathode structure comprising:

A sleeve having a truncated conically-shaped top receiver portion with an opening having a predetermined diameter at the center thereof and a bottom lower space;

oxide cathode material formed within, and conforming to the shape of, said top receiver portion and having a conically-shaped portion of oxide cathode material conforming said conically-shaped top receiver portion and exposed through said opening;

a coating layer of platenoid material covering the exposed conically-shaped portion and overlapping an area of said top receiver portion adjacent said opening;

a backing plug which divides the inside of said sleeve to form said top receiver portion and said bottom lower space; and a heater installed in said bottom lower space below said backing plug for indirectly heating said cathode structure.

2. The cathode structure as claimed in claim 1, wherein said sleeve is formed of a welded cylindrical body and a truncated conical cap.

3. The cathode structure as claimed in claim 1, wherein the platinoid elements are selected from Os, Ir and Ru.

* * * * *